US010734125B2

(12) United States Patent
Carvajal et al.

(10) Patent No.: US 10,734,125 B2
(45) Date of Patent: Aug. 4, 2020

(54) NUCLEAR POWERED VACUUM MICROELECTRONIC DEVICE

(71) Applicant: Westinghouse Electric Company LLC, Cranberry Township, PA (US)

(72) Inventors: Jorge V. Carvajal, Irwin, PA (US); Michael D. Heibel, Harrison City, PA (US); Lyman J. Petrosky, Latrobe, PA (US); Tim M. Crede, Cranberry Township, PA (US); Robert W. Flammang, Pittsburgh, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 757 days.

(21) Appl. No.: 15/583,130

(22) Filed: May 1, 2017

(65) Prior Publication Data

US 2018/0315512 A1 Nov. 1, 2018

(51) Int. Cl.

| | |
|---|---|
| ***G21C 17/10*** | (2006.01) |
| ***G21H 1/00*** | (2006.01) |
| *G21C 7/36* | (2006.01) |
| *G21C 23/00* | (2006.01) |

(52) U.S. Cl.

CPC ..... *G21C 17/10* (2013.01); *G21C 17/102* (2013.01); *G21H 1/00* (2013.01); *G21C 7/36* (2013.01); *G21C 23/00* (2013.01)

(58) Field of Classification Search

CPC ..... G21C 17/10; G21C 17/102; G21H 1/00

USPC ..... 376/255, 321

See application file for complete search history.

(56) References Cited

U.S. PATENT DOCUMENTS

| | | | | |
|---|---|---|---|---|
| 5,251,242 | A | 10/1993 | Impink, Jr. et al. | |
| 6,064,137 | A * | 5/2000 | Cox | H02N 3/00 310/306 |
| 2011/0064181 | A1 | 3/2011 | Moen et al. | |
| 2013/0083879 | A1 | 4/2013 | Heibel et al. | |
| 2015/0098544 | A1 | 4/2015 | Blanovsky | |

FOREIGN PATENT DOCUMENTS

| | | | |
|---|---|---|---|
| DE | 102012111872 | A1 | 6/2014 |
| WO | 2012/094026 | A1 | 7/2012 |

OTHER PUBLICATIONS

International Search Report and Written Opinion of the International Searching Authority for PCT/US2018/023453 dated Jul. 10, 2018 (Forms PCT/ISA/220, PCT/ISA/210 and PCT/ISA/237).

* cited by examiner

*Primary Examiner* — Jack W Keith
*Assistant Examiner* — Daniel Wasil
(74) *Attorney, Agent, or Firm* — K&L Gates LLP

(57) ABSTRACT

A vacuum micro-electronics device that utilizes fissile material capable of using the existing neutron leakage from the fuel assemblies of a nuclear reactor to produce thermal energy to power the heater/cathode element of the vacuum micro-electronics device and a self-powered detector emitter to produce the voltage/current necessary to power the anode/plate terminal of the vacuum micro-electronics device.

20 Claims, 5 Drawing Sheets

NUCLEAR POWERED VACUUM MICROELECTRONIC DEVICE

BACKGROUND

1. Field

This invention pertains in general to self-contained power supplies and, more particularly, to such a power supply that is designed to operate in the vicinity of a radiation source

2. Related Art

Conventional nuclear reactors require reactor vessel penetrations for the cabling that communicates signals from the in-core instrumentation to the control room. The penetrations are often a source of leakage of reactor coolant over the life of the reactor vessel. Therefore, it has always been an objective to reduce the number of reactor vessel penetrations to the minimum required for safe operation of the nuclear plant. One way to reduce the number of in-core instrumentation penetrations is to transmit the in-core detector signals wirelessly. However, wireless transmission of the detector signals would require a self-sustaining power source within the reactor vessel. It is well understood that conventional power sources such as chemical batteries, thermoelectric generators or vibration energy harvesters that would traditionally provide the voltage and current for such a wireless transmitter, cannot survive the in-core environment of a nuclear reactor.

It is also well known that vacuum micro-electronics (VME) devices can survive the reactor in-core environment, but devices based upon that technology also require a power source located within the interior of the reactor vessel. As schematically illustrated in FIG. 1 vacuum micro-electronic devices 10 are typically powered, in part, by a heater circuit (filament heater) 12, which is part of or in contact with a cathode 14. The cathode emits electrons when the heater circuit reaches the appropriate thermal energy. These electrons travel from the cathode 14 to an anode 16 as shown in FIG. 1 by the arrow 20. In conventional applications, the heater element and the anode/plate terminal are simply powered by a combination of direct voltage and current from a power supply. The terminal 18, commonly referred to as the "Grid," controls the flow of electrons between the cathode 14 and anode 16 based upon the voltage bias applied to the grid 18. The voltage bias to operate the grid 18 and the anode 16 is much less than that required to heat the cathode 14. Thus, to facilitate wireless transmission of in-core detector signals out of the reactor vessel a new source of power is required to operate a vacuum micro-electronic device that can withstand the environment of a nuclear reactor, preferably, for as long as the fuel assembly, in which the in-core detector assembly is embedded, is to remain in the reactor core. It is an object of this invention to provide a vacuum micro-electronics device with such a power source and preferably one such source that can power the in-core detector assembly for so long as the fuel assembly is an environmental risk.

SUMMARY

This invention achieves the foregoing objective by providing an in-core electronics assembly including a solid state vacuum micro-electronics device. The solid state vacuum micro-electronic device comprises a cathode element; an anode element; a means for establishing a voltage bias between the grid and ground; and a voltage source for establishing a desired voltage bias between the anode element and ground. A housing sealably encloses the cathode, the anode and the grid and a heater is disposed within the housing proximate or as part of the cathode for heating the cathode, wherein the heater comprises fissile material.

In one embodiment, the cathode element is wrapped around the fissile material. In another embodiment, the cathode element extends through the fissile material. Preferably, the dimensions of the fissile material is not larger than 0.1 inch in height and 0.230 inch in diameter. In one such embodiment, the fissile material is uranium dioxide less than 5 w/o.

Preferably, the voltage source is responsive to irradiation within a reactor core to provide the desired voltage and in one such embodiment the voltage source is a self-powered in-core radiation detector. The in-core electronics assembly also includes one or more sensors with signal outputs that are monitored through the grid. Desirably, the in-core electronics assembly includes a wireless transmitter which is powered by the solid state vacuum micro-electronic device. The invention also contemplates a solid state vacuum micro-electronic device comprising some of the foregoing elements.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Figure 1:
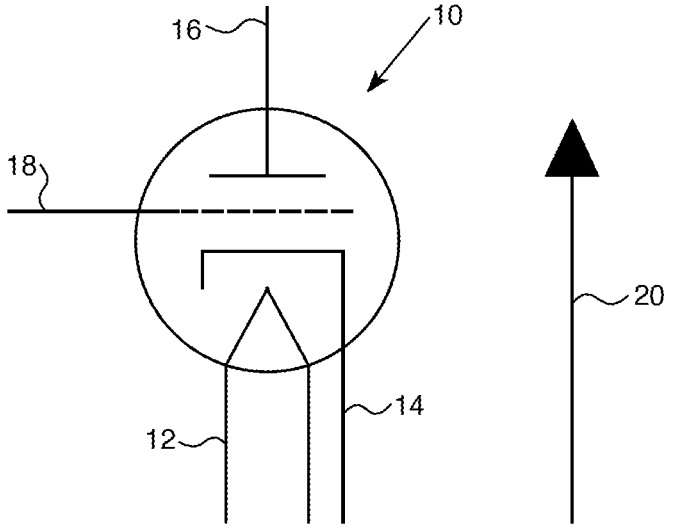
FIG. 1 (Prior Art)
FIG. 1 is a schematic view of a standard solid state vacuum micro-electronic device.
Figure 2:
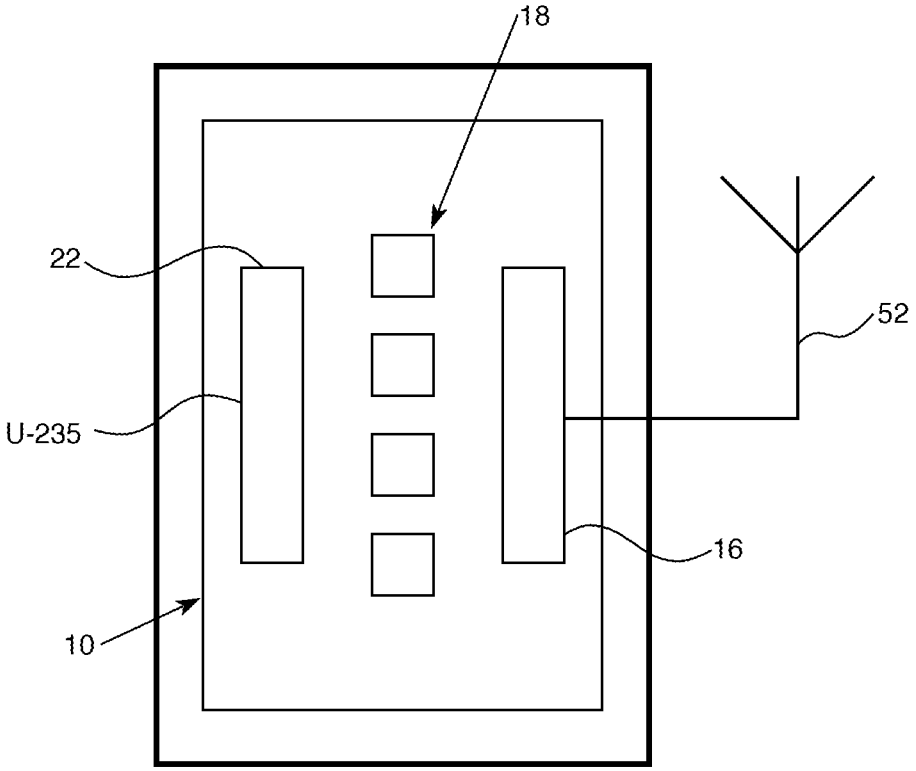
FIG. 2 is a schematic view of a solid state vacuum micro-electronic device incorporating the features of this invention.
Figure 5:
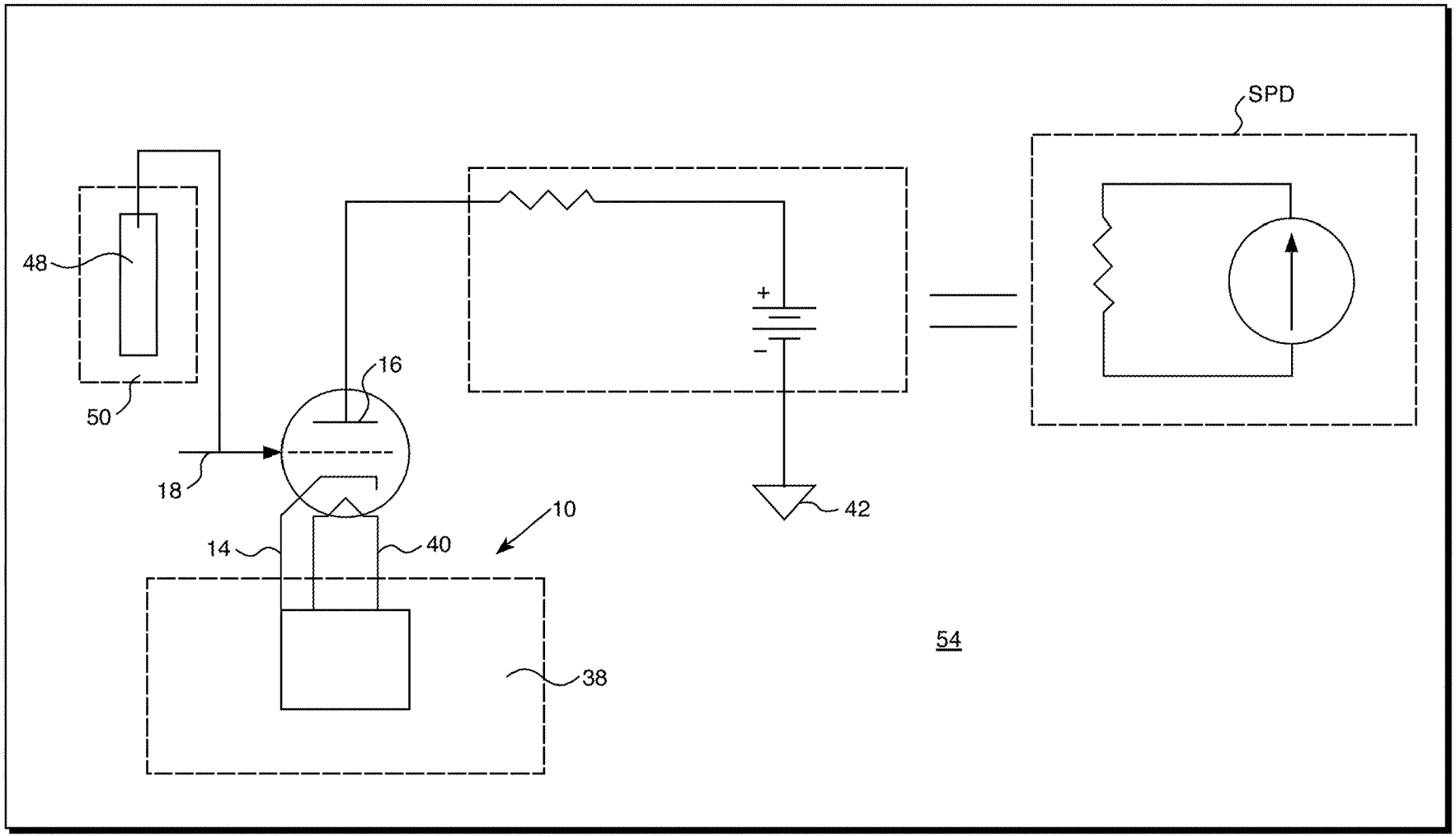
FIG. 5 is a schematic view of a vacuum micro-electronics (triode) device constructed in accordance with one embodiment of this invention.
Figure 7:
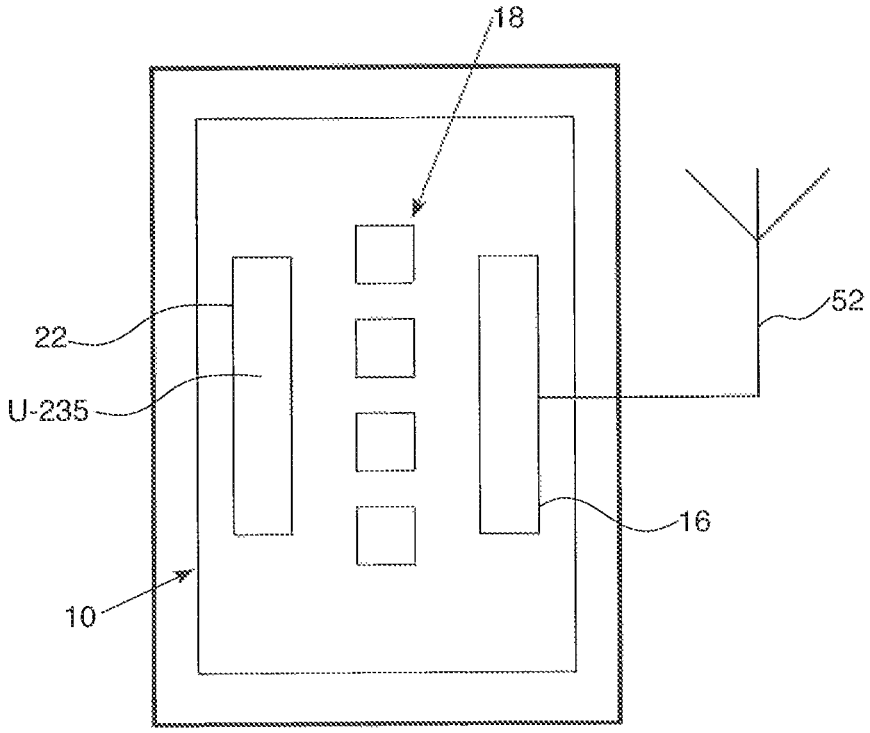
FIG. 7 is a schematic view of an embodiment of a solid state vacuum micro-electronic device incorporating the features of this invention wherein the cathode/heater surrounds fissile material.

The preferred embodiment of this invention comprises a vacuum micro-electronics (VME) device with a fissionable heater element capable of producing the energy necessary to power the vacuum micro-electronics device directly from the thermal energy produced by fissile material, such as U-235. FIG. 2 shows a high level representation of vacuum micro-electronics device 10 being powered by the U-235 heater/cathode element 22. In FIG. 2, U-235 is coated on the cathode 14. Alternately, the heater/cathode element 22 can either be wrapped around or run through the fissile material, as shown in FIGS. 7 and 5, respectively. The fissile material will heat up as it absorbs neutrons that are leaked from the reactor core. The dimensions of the fissile material are preferably, approximately 0.1 inch in height by 0.260 inch diameter in order to fit into a typical VME. The fissile material is preferably a uranium dioxide (UO2) pellet with low enriched (ideally less than 5 w/o) U-235, however, other fissile material can also be used.

Figure 3:
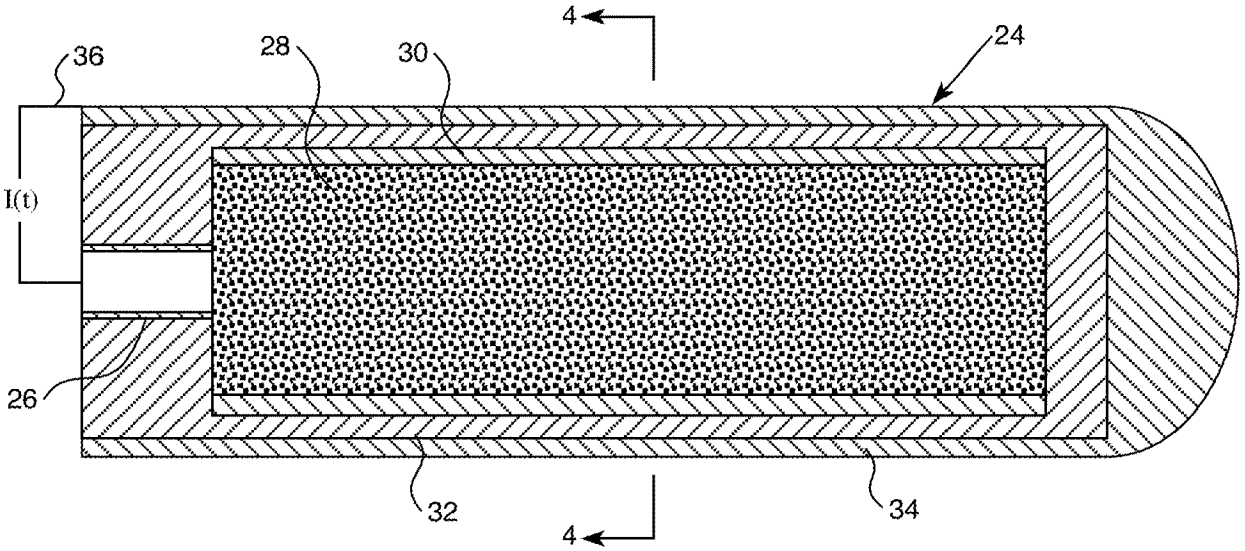
FIG. 3 is a longitudinal, cross sectional view of a self-powered detector, which can be employed with this invention to establish a potential bias at the anode.
Figure 4:
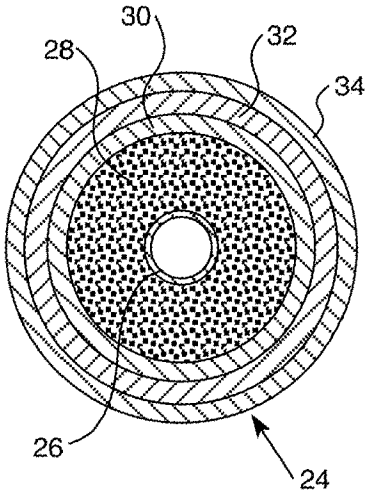
FIG. 4 is a radial cross sectional view of the self-powered detector shown in FIG. 3.

Another important aspect of this invention deals with powering the anode/plate terminal 16 of the VME. The anode/plate terminal of the VME can be connected to a self-powered detector (SPD) emitter or several SPDs in order to generate the required electrical power needed. Typical SPDs behave like ideal current sources and produce a current proportional to the neutron flux as described in US 2013/0083879. This invention utilizes the SPDs properties to create a potential difference across the VME anode terminal 16. FIG. 3 shows a longitudinal cross section of an SPD which can be used to establish a bias across the anode 16 and FIG. 4 is a radial cross section of the SPD of FIG. 3. The SPD, shown in FIGS. 3 and 4, has an emitter 26 that is connected to the anode 16 through an electrical lead 36. The emitter 26 is surrounded by Co-59, identified by reference character 28, which is surrounded by a platinum sheath 30. The assembly of the emitter, Co-59 and platinum sheath is surrounded by aluminum oxide insulation 32 and enclosed within a steel outer sheath 34.

FIG. 5 depicts a schematic of a VME (triode) constructed in accordance with this invention inside an in-core electronics assembly 54. The cathode 14 is shown heated by a filament 40 that is heated by a pellet of fissionable material 38. The anode 16 is connected to the emitter 26 of the SPD 24 which applies a biasing potential V between the anode 16 and ground. In FIG. 5, the grid 18 is figuratively shown connected to the sensors' outputs of a fixed in-core instrument assembly 48 disposed within a reactor core 50. One such in-core instrumentation assembly is more fully described in U.S. Pat. No. 5,251,242, assigned to the assignee of this invention.

Figure 6:
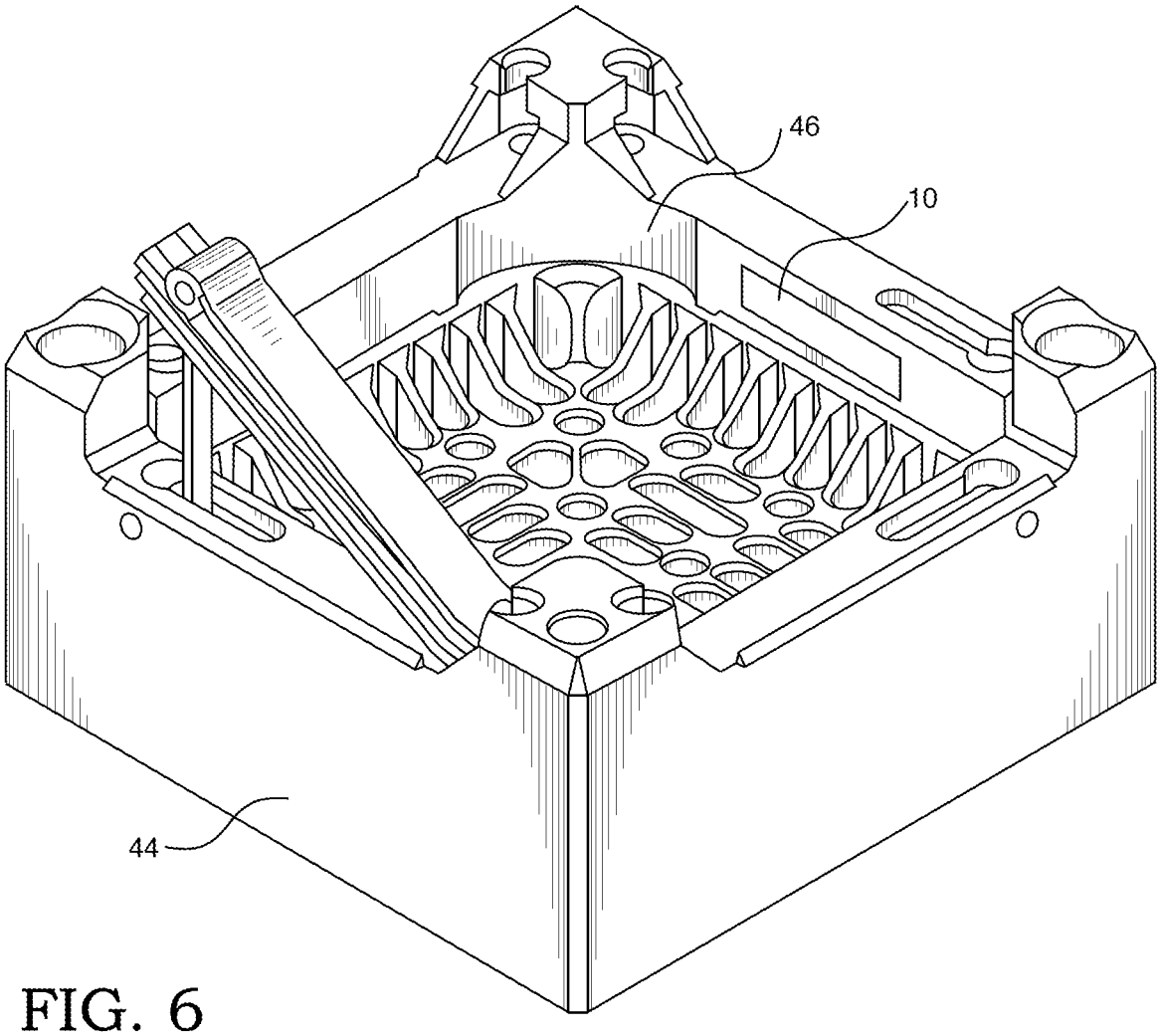
FIG. 6 is a perspective view of a top nozzle of a nuclear fuel assembly in which the solid state vacuum micro-electronics device of this invention can be deployed.

The VME of this invention can be located in the top nozzle of nuclear fuel assembly such as the top nozzle shown in FIG. 6, in which a VME 10 constructed in accordance with this invention is shown in block form attached to a sidewall 46 of the nozzle 44. A calculational analysis was performed, assuming that the pellet of fissionable material is approximately 12 inches above the active core, and showed there would be roughly 5% of the core average thermal flux ($3\times10^{12}$ n/cm$^2$-s) at the VME's location and would produce a measurable thermal energy over the life of a fuel assembly. The number of VMEs that would be required to power a wireless transmitter 52 would then only depend on the transmitter's power requirements.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. An in-core electronics assembly including a solid state vacuum micro-electronic device comprising:
- a cathode element;
- an anode element;
- a grid disposed between the cathode and the anode;
- an in-core instrument assembly;
- a means within the in-core instrument assembly for establishing a voltage bias between the grid and ground;
- a voltage source for establishing a voltage bias between the anode element and ground;
- a housing for sealably enclosing the cathode, the anode and the grid; and
- a heater disposed within the housing proximate or as part of the cathode for heating the cathode,
  - wherein the heater comprises fissile material for production of thermal energy to power the vacuum micro-electronic device.

2. The in-core electronics assembly of claim 1, wherein the cathode element is wrapped around the fissile material.

3. The in-core electronics assembly of claim 1, wherein the cathode element extends through the fissile material.

4. The in-core electronics assembly of claim 1, wherein the dimensions of the fissile material is not larger than 0.1 inch in height and 0.260 inch in diameter.

5. The in-core electronics assembly of claim 1, wherein the fissile material is uranium dioxide less than 5 w/o.

6. The in-core electronics assembly of claim 1, wherein the voltage source is responsive to irradiation within a reactor core to provide the voltage.

7. The in-core electronics assembly of claim 6, wherein the voltage source is a self-powered in-core radiation detector.

8. The in-core electronics assembly of claim 7, wherein the solid state vacuum micro-electronic device powers a wireless transmitter.

9. The in-core electronics assembly of claim 1, wherein the solid state vacuum micro-electronic device is configured to attach to a top nozzle of a nuclear fuel assembly.

10. The in-core electronics assembly of claim 1, wherein the in-core electronics assembly includes one or more sensors having signal outputs which are electrically communicated to the grid.

11. A solid state vacuum micro-electronic device comprising:
- a cathode element;
- an anode element;
- a grid disposed between the cathode and the anode;
- an in-core instrument assembly;
- a means within the in-core instrument assembly for establishing a voltage bias between the grid and ground;
- a voltage source for establishing a voltage bias between the anode element and ground;
- a housing for sealably enclosing the cathode, the anode and the grid; and
- a heater disposed within the housing proximate or as part of the cathode for heating the cathode,
  - wherein the heater comprises fissile material for production of thermal energy to power the vacuum micro-electronic device.

12. The solid state vacuum micro-electronic device of claim 11, wherein the cathode element is wrapped around the fissile material.

13. The solid state vacuum micro-electronic device of claim 11, wherein the cathode element extends through the fissile material.

14. The solid state vacuum micro-electronic device of claim 11, wherein the dimensions of the fissile material is not larger than 0.1 inch in height and 0.260 inch in diameter.

15. The solid state vacuum micro-electronic device of claim 11, wherein the fissile material is uranium dioxide less than 5 w/o.

16. A nuclear fuel assembly comprising:
- a top nozzle;

a bottom nozzle;

a plurality of elongated thimbles extending between and attached to the top nozzle and the bottom nozzle; and a plurality of elongated nuclear fuel elements laterally supported in spaced relationship between the top nozzle and the bottom nozzle;

the nuclear fuel assembly further including a solid state vacuum micro-electronics device comprising:

a cathode element;

an anode element;

a grid disposed between the cathode and the anode;

an in-core instrument assembly;

a means within the in-core instrument assembly for establishing a voltage bias between the grid and ground;

a voltage source for establishing a voltage bias between the anode element and ground;

a housing for sealably enclosing the cathode, the anode and the grid; and a heater disposed within the housing proximate or as part of the cathode for heating the cathode, wherein the heater comprises fissile material for production of thermal energy to power the vacuum micro-electronic device.

17. The nuclear fuel assembly of claim 16, wherein the cathode element is wrapped around the fissile material.

18. The nuclear fuel assembly of claim 16, wherein the cathode element extends through the fissile material.

19. The nuclear fuel assembly of claim 16, wherein the dimensions of the fissile material is not larger than 0.1 inch in height and 0.260 inch in diameter.

20. The nuclear fuel assembly of claim 16, wherein the fissile material is uranium dioxide less than 5 w/o.

* * * * *